US010665997B1

(12) United States Patent
Lee et al.

(10) Patent No.: US 10,665,997 B1
(45) Date of Patent: May 26, 2020

(54) ADAPTOR FOR ORNAMENTAL LIGHT EMITTING DEVICE AND CANDOLIER INCLUDING THE SAME

(71) Applicant: PTC International, Inc., Baltimore, MD (US)

(72) Inventors: Michael Sangyup Lee, Pikesville, MD (US); Gianni Andracchio, Baltimore, MD (US); Kurt Ciliberto, Baltimore, MD (US)

(73) Assignee: PTC International, Inc., Baltimore, MD (US)

( * ) Notice: Subject to any disclaimer, the term of this patent is extended or adjusted under 35 U.S.C. 154(b) by 0 days.

(21) Appl. No.: 16/240,590

(22) Filed: Jan. 4, 2019

(51) Int. Cl.

| | |
|---|---|
| ***H01R 33/945*** | (2006.01) |
| ***H01R 33/94*** | (2006.01) |
| ***H01R 33/90*** | (2006.01) |
| ***H01R 13/717*** | (2006.01) |
| ***H01R 13/66*** | (2006.01) |
| ***F21K 9/232*** | (2016.01) |
| ***F21V 3/02*** | (2006.01) |
| ***F21V 23/06*** | (2006.01) |
| ***H05B 33/08*** | (2020.01) |
| *F21W 121/00* | (2006.01) |
| *F21Y 115/10* | (2016.01) |

(52) U.S. Cl.
CPC ..... *H01R 13/7175* (2013.01); *F21K 9/232* (2016.08); *F21V 3/02* (2013.01); *F21V 23/06* (2013.01); *H01R 13/6658* (2013.01); *H01R 33/9453* (2013.01); *H05B 33/0809* (2013.01); *F21W 2121/00* (2013.01); *F21Y 2115/10* (2016.08)

(58) Field of Classification Search
CPC ..... H01R 13/7175; H01R 33/9453; H01R 13/6658; H05B 33/0809; F21V 3/02; F21V 23/06; F21K 9/232; F21Y 2115/10; F21W 2121/00
See application file for complete search history.

(56) References Cited

U.S. PATENT DOCUMENTS

| | | | | |
|---|---|---|---|---|
| 6,113,433 | A | 9/2000 | Al-Turki | |
| 6,679,620 | B2 * | 1/2004 | Patz | F21S 8/06 362/308 |
| 7,311,425 | B2 * | 12/2007 | Jervey, III | F21S 8/06 362/391 |
| 7,976,211 | B2 | 7/2011 | Shinozaki | |
| 8,410,701 | B2 | 4/2013 | Lee et al. | |
| 9,651,209 | B2 * | 5/2017 | Demuynck | H05B 33/0803 |

(Continued)

OTHER PUBLICATIONS

Worth Home Products PBN-3224-0030, available at https://www.lightingdirect.com/worth-home-products-pbn-3224-0030-instant-pendant-series-single-light-6-5-wide-recessed-lighting-conversion-kit/p2025451 (last visited Nov. 30, 2017).

*Primary Examiner* — Tracie Y Green
(74) *Attorney, Agent, or Firm* — H.C. Park & Associates, PLC

(57) ABSTRACT

An adaptor to drive DC powered light emitting device from an AC power source includes a main body having a first coupler configured to be connected to an external AC socket, a printed circuit board (PCB) disposed in the main body, an auxiliary body having a second coupler configured to be connected to the DC powered light emitting device, and a flexible, adjustable length connector extending outwardly from the main body between the PCB and the second coupler.

8 Claims, 10 Drawing Sheets

(56) References Cited

U.S. PATENT DOCUMENTS

| | | | | |
|---|---|---|---|---|
| 2010/0296685 | A1* | 11/2010 | Carle, Jr. | F21V 21/03 381/386 |
| 2011/0161687 | A1* | 6/2011 | Tajima | G06F 1/266 713/300 |
| 2011/0227510 | A1* | 9/2011 | Elberbaum | G08C 23/06 315/363 |
| 2012/0326623 | A1 | 12/2012 | Fatt et al. | |
| 2013/0294098 | A1 | 11/2013 | Yeh | |
| 2015/0377461 | A1* | 12/2015 | Hutchins | F21S 8/065 362/237 |
| 2017/0191645 | A1 | 10/2017 | Weston et al. | |
| 2017/0311399 | A1* | 10/2017 | Shah | F21K 9/68 |
| 2018/0128465 | A1* | 5/2018 | Sonneman | F21V 23/06 |

* cited by examiner

800

ADAPTOR FOR ORNAMENTAL LIGHT EMITTING DEVICE AND CANDOLIER INCLUDING THE SAME

BACKGROUND

Field

Exemplary implementations of the invention relate generally to a lighting power adaptor for a light emitting device and, more specifically, to an adaptor to drive at least one DC powered light emitting device by an AC power source.

Discussion of the Background

A light socket or receptacle is typically provided on a ceiling of a commercial or residential property. The light socket is typically connected to a conventional alternating current (AC) power source any may be coupled to a compatible AC powered lighting device, such as an incandescent light bulb to provide AC power to the conventional light bulb to emit light.

In recent years, direct current (DC) powered light emitting devices, such as a light emitting diode (LED), have been rapidly replacing conventional AC powered light devices due to its longer lifetime, quicker response, and lower power consumption. A DC powered light emitting device may not operate effectively during the reverse cycle of AC power, and thus, a DC powered light emitting device may generally require a separate power converter or a circuit for operation in connection with an existing light socket.

DC powered light emitting devices, such as LEDs, are mass produced globally at reduced prices, which has enabled wide usage of the LED in various technological fields, such as in electronic devices, general lighting, sign boards, and etc.

However, since a DC powered light emitting device, such as candoliers and other lighting devices incorporating one or more LEDs, cannot generally be coupled directly to an easily accessible power source, such as light socket found in commercial or residential properties, the application of DC powered light emitting devices has been somewhat limited. Furthermore, when an LED lighting device incorporates a power converter or the like, such device may have increased costs, which may not be feasible in various applications such as lighting device used in advertising, which must keep up the latest needs and trends.

The above information disclosed in this Background section is only for understanding of the background of the inventive concepts, and, therefore, it may contain information that does not constitute prior art.

SUMMARY

A lighting power adaptor constructed according to the principles and exemplary implementations of the invention, and a candolier including the same, are capable of coupling a DC powered light emitting device to a conventional light socket.

A lighting power adaptor constructed according to the principles and exemplary implementations of the invention is capable of significantly reducing thermal and electromagnetic interference between an electronics board and DC powered light emitting device by utilizing a flexible, adjustable length wire.

A candolier constructed according to the principles and exemplary implementations of the invention may provide a platform for conveniently using at least three dimensional DC powered light emitting devices, such as one or more paddles, with a single existing AC power source. The paddles have desired shapes or other characteristics can be easily replaced with another paddle as desired, and may be easily used in standard AC light sockets in connection with a lighting power adaptor.

Additional features of the inventive concepts will be set forth in the description which follows, and in part will be apparent from the description, or may be learned by practice of the inventive concepts.

An adaptor to drive DC powered light emitting device from an AC power source according to an exemplary embodiment includes a main body having a first coupler configured to be connected to an external AC socket, a printed circuit board (PCB) disposed in the main body, an auxiliary body having a second coupler configured to be connected to the DC powered light emitting device, and an adjustable length connector extending outwardly from the main body between the PCB and the second coupler.

The main body may include an upper body and a lower body detachably coupled to each other.

A portion of the main body adjoining the upper body and the lower body may have the greatest width for accommodating any excessive portion of the connector.

The connector may include a first portion disposed in the main body and a second portion disposed in the auxiliary body, and at least one of the first and second portions may be flexible.

The PCB may include a step down converter.

The adaptor may further include a holder disposed in the main body to secure the position of the connector.

The auxiliary body may include a cover connected to the connector and enclosing the second coupler, and the first and second couplers may include threads.

A portion of the cover may be configured to be surrounded by a portion of the DC powered light emitting device.

The adaptor may further include a lighting device disposed on the PCB to signal operational status.

A candolier according to an exemplary embodiment includes at least one DC powered light emitting device including a light emitting diode (LED) incorporated into an ornamental device, and an adaptor to drive the at least one DC powered light emitting device from an AC power source, the adaptor having a main body including a first coupler configured to be connected to an external AC socket, a printed circuit board (PCB) disposed in the main body, an auxiliary body having a second coupler configured to be connected to the DC powered light emitting device, and an adjustable length connector extending outwardly from the main body between the PCB and the second coupler.

The ornamental device may include at least one of a useful article, sign decoration, logo, paddle, bottle, clover, and sign.

The ornamental device may include an object having at least one cover disposed over the LED to illuminate the cover.

The LED may include at least one LED strip disposed around the periphery and/or in the interior of the ornamental device.

A candolier according to an exemplary embodiment includes a main body having a first coupler configured to be connected to an external AC socket, an auxiliary body having a second coupler, a connector extending from the main body to the auxiliary body, an extender including a third coupler connected to the second coupler, and a multi-port member having a plurality of receptacles configured to be coupled to DC powered light emitting devices.

The third coupler may be disposed at one end of the extender and the multi-port member is disposed at the other end thereof.

The extender may further include a shaft extending between the second coupler and the multi-port member, and the multi-port member is configured to rotate around the main body.

The multi-port member may have at least one of substantially a circular shape and a cross shape.

The receptacles may include adapter insertion ports disposed around the periphery of the multi-port member.

The candolier may further include an attachment disposed between the multi-port member and the DC powered light emitting device, the attachment having a first end coupled to one of the receptacles and a second, opposing end configured to be coupled to the DC powered light emitting device.

The DC powered light emitting device may include a light emitting diode incorporated into an ornamental device selected from at least one of a useful article, sign decoration, logo, paddle, bottle, clover, and sign.

The first, second, and third couplers may include threads.

The connector may include at least one flexible member.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
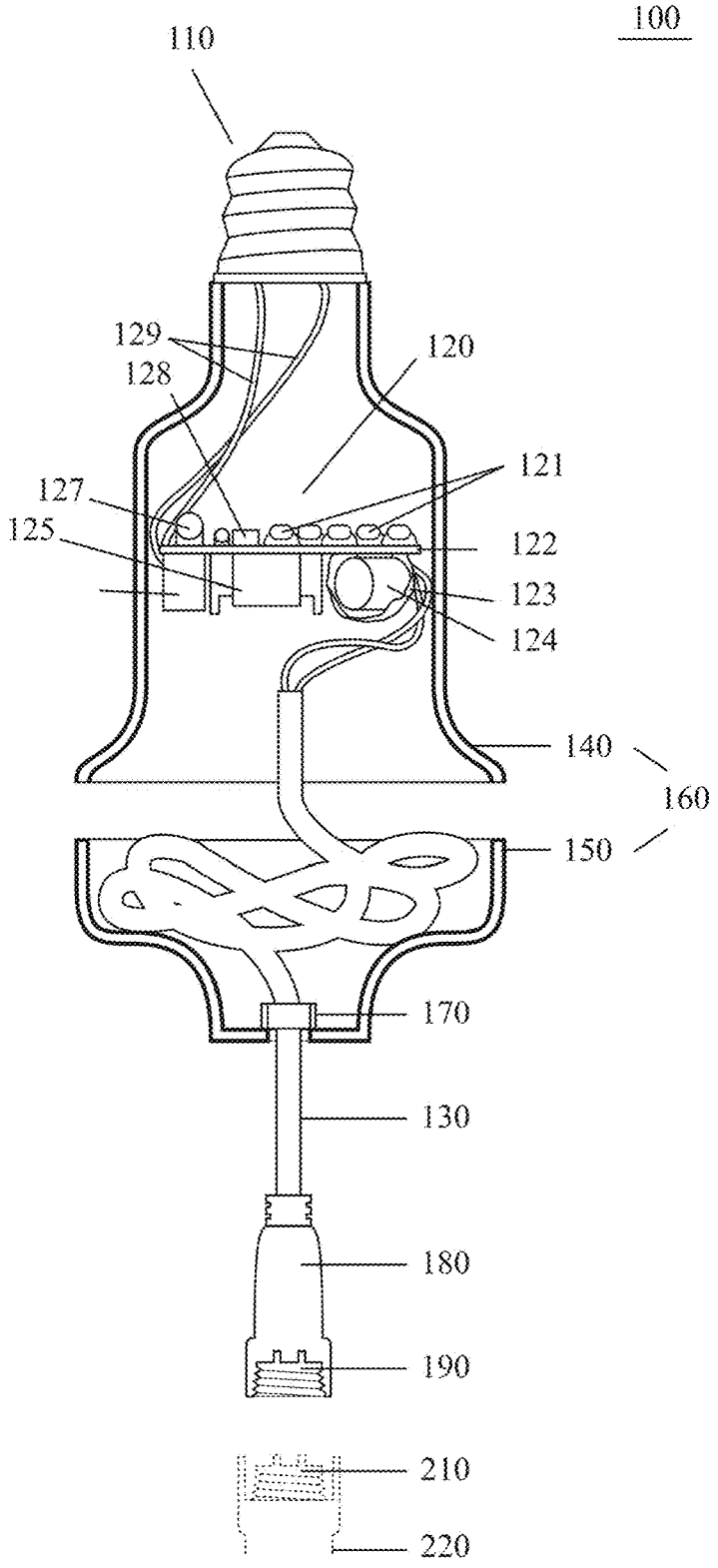
FIG. 1 is a schematic cross-sectional view of a lighting power adaptor constructed according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

The use of cross-hatching and/or shading in the accompanying drawings is generally provided to clarify boundaries between adjacent elements. As such, neither the presence nor the absence of cross-hatching or shading conveys or indicates any preference or requirement for particular materials, material properties, dimensions, proportions, commonalities between illustrated elements, and/or any other characteristic, attribute, property, etc., of the elements, unless specified. Further, in the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Various exemplary embodiments are described herein with reference to sectional and/or exploded illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not necessarily be construed as limited to the particular illustrated shapes of regions, but are to include deviations in shapes that result from, for instance, manufacturing. In this manner, regions illustrated in the drawings may be schematic in nature and the shapes of these regions may not reflect actual shapes of regions of a device and, as such, are not necessarily intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

FIG. 1 is a schematic cross-sectional view of a lighting power adaptor constructed according to the principles of the invention. As used herein, a lighting power adaptor or an adaptor may be any type of electro-mechanical device that is capable of connecting a light emitting device to an external power source and supplying power for driving the light emitting device.

Referring to FIG. 1, a lighting power adaptor 100 according to an exemplary embodiment may include an adaptor coupler 110, a main housing 160, a wire 130, and a cover 180. The adaptor coupler 110 may be connected to an AC power source, such as a conventional light socket to convert AC power to drive one or more DC powered device including one or more light emitting elements, such as an light emitting diode (LED), organic light emitting diode (OLED), active-matrix organic light emitting diode (AMOLED), liquid crystal display (LCD), and the like.

The adaptor coupler 110 according to an exemplary embodiment may be formed on the main housing 160. The adaptor coupler 110 may be in the form of a thread to connect the lighting power adaptor 100 to an external power source, such as standard AC light socket. The standard AC light socket may include E26 and E27 sockets, which are conventional light sockets for a lightbulb operating under 120V and 210V, respectively, as well known in the art. As used herein, the term "coupler" may refer to any type of coupling structure, such as a thread, fastener, clamp, clasp, sliding door, magnetic holder, and the like, which is received in a receptacle to receive power.

According to the illustrated embodiment, the adaptor coupler 110 is formed as a thread disposed on top of the main housing 160. However, the inventive concepts are not limited thereto, and the adaptor coupler 110 may be positioned at any portion of the main housing 160, and constructed to have any shape, so long as the adaptor coupler 110 can stably couple the lighting power adaptor 100 to an external power source, such as the standard AC light socket.

The main housing 160 may include an upper housing 140 and a lower housing 150, which may be detachably coupled to each other. The upper housing 140 and the lower housing 150 may include any type of coupling structure to be coupled to each other, while being readily detachable from each other by a consumer when desired, which will be described in more detail later. The upper housing 140 and the lower hosing 150 according to an exemplary embodiment may be threaded to be coupled to each other, but any other type of detachable connection such as snap fit, magnetically coupled, and the like may be employed.

According to an exemplary embodiment, the width of the upper housing 140 may be gradually be increased from top to bottom. The upper housing 140 may provide a space for accommodating an electronics board 120 therein. The electronics board 120 according to an exemplary embodiment may be a printed circuit board, without being limited thereto. Various electrical components may be disposed on the electronics board 120 to convert one power source to another power source. Hereinafter, the electronics board 120 and electrical components disposed thereon will be collectively referred to as the electronics board 120. The electronics board 120 may receive external AC power through the adaptor coupler 110, and convert AC power to DC power, which is then output through the wire 130 to a socket coupler 190, such as a socket thread.

According to an exemplary embodiment, the electronics board 120 may include an LED 121, a resistor 122, a tube cap 123, a chip resistor 124, a transformer 125, an electrolytic capacitor 126, a thermistor 127, a resistor 128, and input lines 129, which are well known elements in a conventional AC-DC converter. Accordingly, detailed descriptions of the elements formed on the electronics board 120 are unnecessary. In addition, the electronics board 120 may further include various electrical components, such as a rectifier, a controller, a bleeder, a dimmer, and a surge protector, and integrated circuits to implement AC/DC power conversion. The electronics board 120 may be insulated from the main housing 160.

The LED 121 may emit light to show various settings of the lighting power adaptor 100. For example, the LED 121 may include one or more LEDs and emit different colors of light to indicate status of the connection of the lighting power adaptor 100. In addition, the LED 121 may emit different colors of light or emit light in different styles (e.g., flashing) to display various settings of an external device connected to the lighting power adaptor 100. The transformer 125 according to an exemplary embodiment may be a step down converter for converting AC power to a DC voltage or current suitable for driving DC powered light emitting device, such as an LED.

The wire 130 according to an exemplary embodiment may be connected to the electronics board 120, and includes the socket coupler 190 at one end thereof. The wire 130 may be any type of flexible, adjustable length member capable of transmitting power. For example, the wire 130 may be formed of one or more cables connected between the electronics board 120 and the socket coupler 190, and may be covered by an insulating material. According to an exemplary embodiment, the wire 130 may have heat resistant or electromagnetic resistant properties. The wire 130 may have a sufficient length to adjust the length of the wire 130 extending outwardly from the main housing 160, as desired, which will be described in more detail below. In some exemplary embodiments, the wire 130 may be a rigid wire or a hard electric line to transmit power, such that a paddle connected to the wire 130 can be located at a desired position, such as in an inverse direction.

The socket coupler 190 may be electrically connected to the wire 130 to provide power to an external device, such as a multi-piece attachment member and/or a paddle described in more detail below. The socket coupler 190 according to an exemplary embodiment is surrounded by a cover 180, which may protect the socket coupler 190 from external impact and environment, such as dust and moisture. In some exemplary embodiments, the cover 180 may include an insulating material to prevent electrical shock to a user.

The lower housing 150 according to an exemplary embodiment may have at least one hole through which the wire 130 may extend outwardly from the main housing 160. In this manner, the socket coupler 190 connected to one end of the wire 130 is spaced apart from the main housing 160 by at least a predetermined distance. The lower housing 150 may include a sleeve 170 disposed adjacent to the hole to secure the position of the wire 130. For example, the sleeve 170 may have a size substantially similar to that of the wire 130 to maintain the desired length of the wire 130 by a friction or interference fit, but other types of adjustable retention devices may be employed. For example, in some exemplary embodiments, the sleeve 170 may include a clamp or the like to fix the length of the wire 130.

The lower housing 150, together with the upper housing 140, may provide a space for accommodating any excessive wire 130. According to an exemplary embodiment, the width of the lower housing generally decreases from the top to the bottom. As such, the greatest width of the upper housing 140 and the lower housing 150 may be disposed near an interface therebetween, without being limited thereto. For example, when a portion of the wire 130 extending outwardly from the main body 160 is less than the entire length of the wire 130, the remaining (or excessive) portion of the wire 130 may be accommodated within the main housing 160. In some implementations, the excessive portion of the wire 130 may be entangled (or gathered) within the main housing 160 to significantly block a pathway of heat or electromagnetic field between the electronics board 120 and a paddle (see FIG. 7), so as to prevent any thermal or electromagnetic interference therebetween. In other implementations, the length of the wire 130 extending outside of the main housing 160 may be increased, and as such, the distance from the paddle to the electronics board 120 may be increased. In this manner, thermal or electrical interference between the electronics board 120 and the paddle (and between the socket coupler 190 and the electronics board 120) may also be prevented by the increased in spacing therebetween, even though a pathway of heat or electromagnetic field is not substantially blocked by the excessive wire 130 within the main housing 160.

In an exemplary embodiment, the main housing 160 may be formed of any suitable material, such as metal, polymer, or glass. In some exemplary embodiments, the upper housing 140 may be formed of a material different from the lower housing 150*a*. In addition, the main housing 160 is some exemplary embodiments may further include a mechanical retractor member to organize the excessive wire 130 within the main housing 160 and adjust the length of the wire 130.

Figure 2:
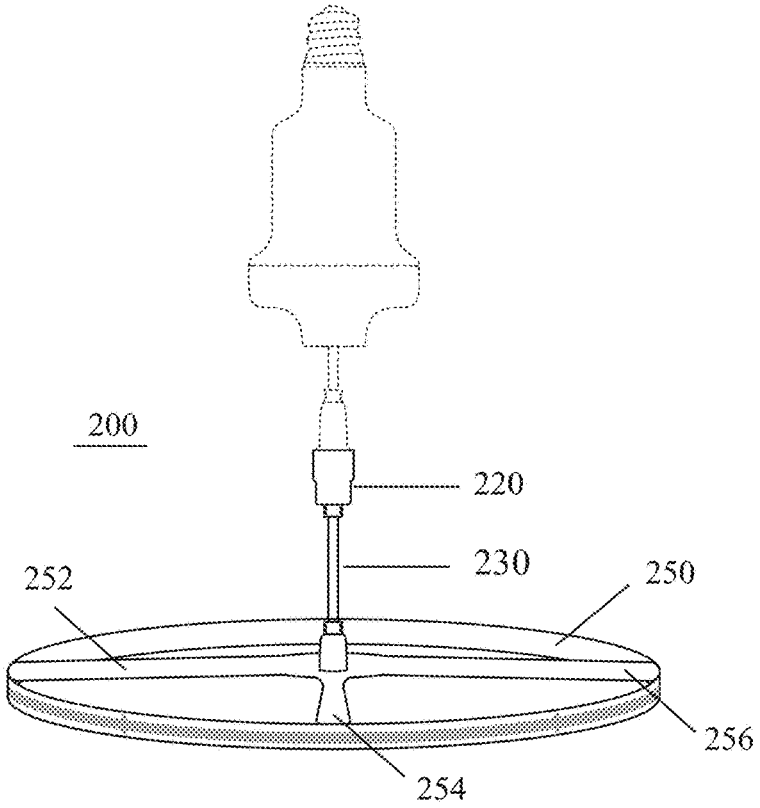
FIG. 2 is a schematic view of multi-piece attachment member in the form of an attachment ring according to an exemplary embodiment.

FIG. 2 is a schematic view of a multi-piece attachment member in the form of an attachment according to an exemplary embodiment.

Referring to FIG. 2, the multi-piece attachment member 200 is in the form of a ring coupled to the lighting power adaptor 100, and may include a multi-piece attachment ring coupler 210, such as a thread (see FIG. 1), a multi-piece attachment ring cover 220, a shaft 230, and a paddle hanger 250, which is illustrated as being circular in shape, but may have other shapes and forms.

The multi-piece attachment ring coupler 210 may be coupled to the socket coupler 190 of the lighting power adaptor 100 of FIG. 1. While illustrated as a threaded connection, attachment between the multi-piece attachment ring coupler 210 and the socket coupler 190 may have any type of coupling structure and shape, so long as it can stably couple the multi-piece attachment member 200 to the lighting power adaptor 100.

The multi-piece attachment ring coupler 210 may be surrounded by the multi-piece attachment ring cover 220, which may protect the multi-piece attachment ring coupler 210 from external impact and environment, such as dust and moisture. In some exemplary embodiments, the multi-piece attachment ring coupler 210 may include an insulating material to prevent electrical shock. According to an exemplary embodiment, when the multi-piece attachment ring coupler 210 and the socket coupler 190 are coupled to each other, the multi-piece attachment ring cover 220 surrounding the multi-piece attachment ring coupler 210 may cover a portion of the cover 180 surrounding the socket coupler 190. In this manner, the connection between the lighting power adaptor 100 and the multi-piece attachment member 200 may be further secured, as well as preventing any external substances from infiltrating into the interface of the lighting power adaptor 100 and the multi-piece attachment member 200.

The shaft 230 may be an elongated member connecting the multi-piece attachment ring cover 220 to the paddle hanger 250. In some implementations, the shaft 230 may be connected to a motor or the like, which may be surrounded by the multi-piece attachment ring cover 220 to cause the paddle hanger 250 to rotate around the main housing 160. For example, one or more of the multi-piece attachment ring cover 220, the shaft 230, and the paddle hanger 250 may include conductors electrically contacting each other at an interface therebetween to provide electrical path without employing a wiring, such that electrical connection between the members may not be adversely affected by the rotational movement of the paddle hanger 250.

Figure 3:
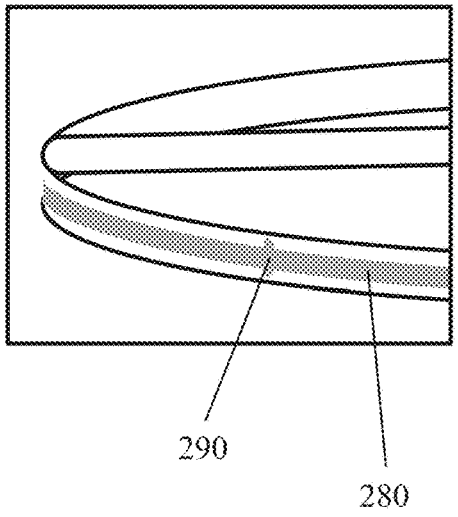
FIG. 3 is an enlarged schematic view of a part of the multi-piece attachment ring of FIG. 2 according to an exemplary embodiment.

Referring to FIGS. 2 and 3, the paddle hanger 250 according to an exemplary embodiment may have substantially a circular shape formed by an annular ring 252 and cross shaped support struts 254 and 256. Annular ring 252 includes a channel 280 formed around the outer circumference thereof. The channel 280 may include multiple adaptor insertion portions 290 spaced apart from each other along the channel 280. Each adaptor insertion portion 290 in the channel 280 may provide converted power from the lighting power adaptor to a paddle, and may be recessed inwards to provide a receptacle into which an attachment (see FIG. 4) may be inserted to. However, the inventive concepts are not limited thereto, and the channel 280 may be formed in anywhere on the paddle hanger 250, as long as the channel 280 can include multiple adaptor insertion portions 290 spaced apart from each other. In addition, the multiple adaptor insertion portions 290 may have any shape suitable for coupling a paddle (or an attachment of FIG. 4) to the paddle hanger 250.

In some exemplary embodiments, the shape of the paddle hanger 250 may be variously modified as desired. For example, the paddle hanger 250 may have substantially a cross shape (see FIG. 7), a polygonal shape, a star shape, and the like.

Figure 4:
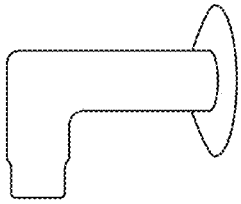
FIG. 4 is a schematic view of an attachment to couple the attachment ring to a LED lighting device according to an exemplary embodiment.

FIG. 4 is a schematic view of an attachment to couple the attachment ring to a LED lighting device according to an exemplary embodiment. As used herein, an attachment may refer to any type of electromechanical device capable of transmitting power and stably coupling one element to another.

Referring to FIG. 4, the attachment 400 may have one end configured to be inserted into the adaptor insertion portion 290 of the multi-piece attachment member 200, and the other end configured to be coupled to a paddle. The attachment 400 may have substantially an "L" or elbow shape, but the inventive concepts are not limited thereto a particular shape thereof. More particularly, the attachment 400 may have any shape so long as the attachment 400 may firmly connect the paddle to the multi-piece attachment member 200, and provide power from the multi-piece attachment member 200 to the paddle. More particularly, one or both ends of the attachment 400 may include a thread, a fastener, a socket, a magnetic member, a protrusion, a depression, or the like.

Figure 5:
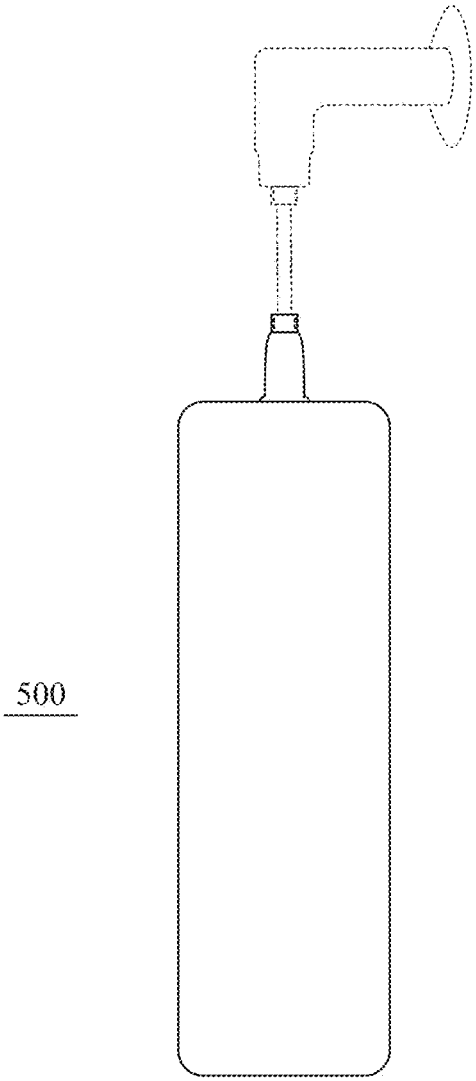
FIG. 5 is a schematic view of a LED light device in the form of a paddle according to an exemplary embodiment.

FIG. 5 is a schematic view of a LED lighting device in the form of a paddle according to an exemplary embodiment.

Referring to FIG. 5, the paddle 500 according to an exemplary embodiment may be an ornamental and/or informational device coupled to the attachment 400 of FIG. 4. The paddle 500 may include a light emitting device to emit light in response to receiving power through the attachment 400. The light emitting device of the paddle 500 may include DC driven (or powered) light emitting device, such as an LED, OLED, AMOLED, LCD, and the like. Alternatively, the light emitting device may be an AC powered light emitting device, such as incandescent lamp. In this case, the electronics board 120 may transmit external AC power without power conversion to DC. Although FIG. 5 shows the paddle 500 as having a rounded rectangular shape, the inventive concepts are not limited to a particular shape of the paddle 500. In particular, the paddle 500 may have any desired shape to stand itself out with light emitted therefrom, which is particularly useful in promotions, advertisements, signage and/or decorations for use in retail shops, restaurants, businesses, stores, and dwellings, which will be described in more detail below.

Figure 6:
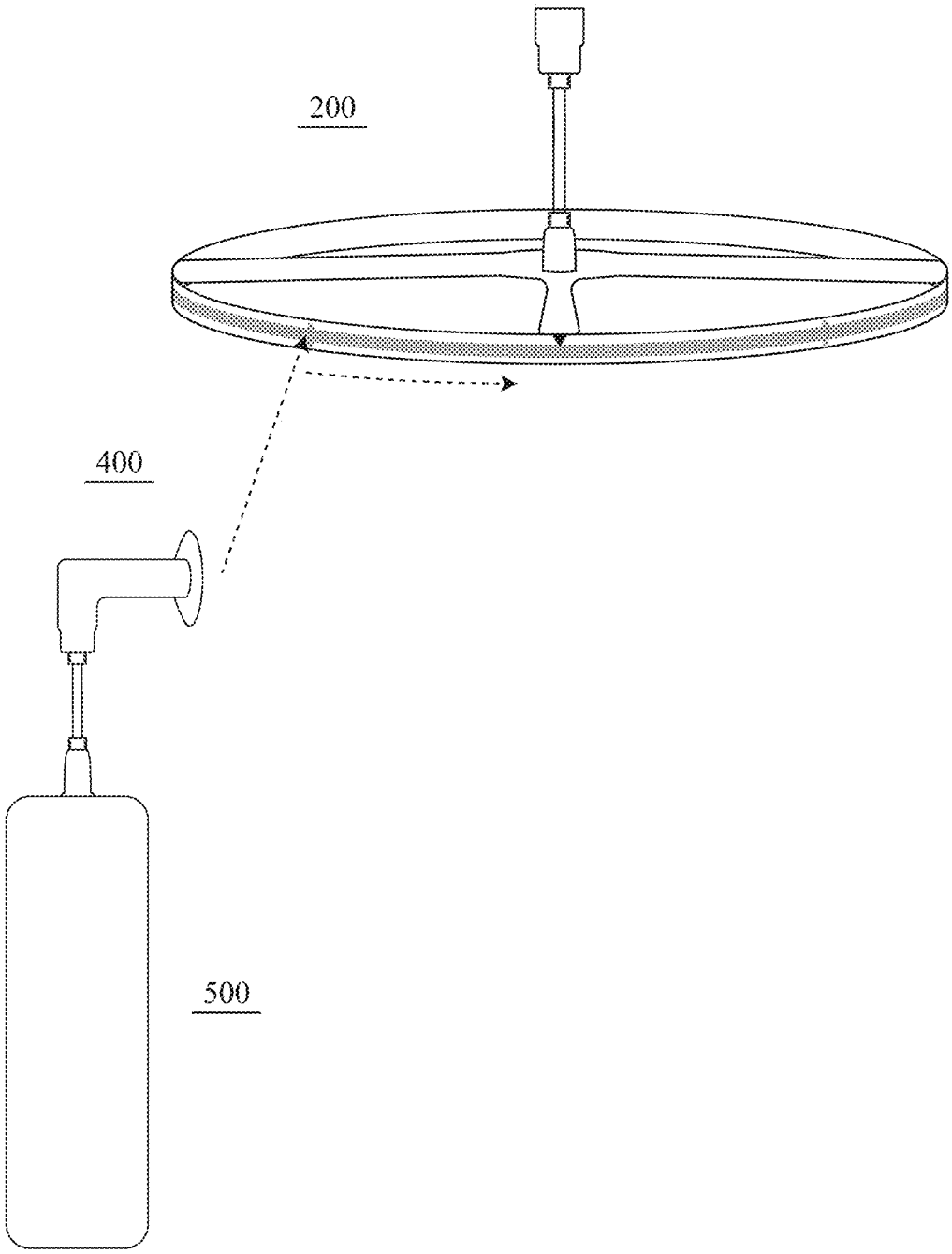
FIG. 6 illustrates a paddle attached to an attachment being coupled to the multi-piece attachment ring according to an exemplary embodiment.

FIG. 6 illustrates a paddle connected to the attachment being coupled to the multi-piece attachment ring according to an exemplary embodiment.

Referring to FIG. 6, the paddle 500 according to an exemplary embodiment may be coupled to the attachment 400, which may be inserted into an adaptor insertion portion of the channel formed in the multi-piece attachment member 200. In this manner, the paddle 500 may be electrically connected to the electronics board 120 and be supplied with power to emit light. As described above, the lighting power adaptor may also provide power to cause the paddle hanger of the multi-piece attachment member 200 to rotate around the main housing. For example, the multi-piece attachment member 200 may rotate around or along with the shaft to visually enhance ornamental features of the paddle 500 coupled thereto.

In some implementations, the attachment 400 may include a gear or a separate motor to cause the paddle 500 rotate around the attachment 400. For example, the attachment 400 and the paddle 500 may include conductors electrically contacting each other at an interface therebetween to provide electrical path without employing a wiring, such that electrical connection between the members may not be adversely affected by the rotational movement of the paddle 500. As described above, one or more paddles 500 may be coupled to the multi-piece attachment member 200, and the inventive concepts are not limited to a particular number of paddles 500 coupled to the multi-piece attachment member 200. In some implementations, the electronics board in the main housing may include a controller, such as a suitable microprocessor, which may control the operation of one or more paddles 500 coupled to the multi-piece attachment member 200. For example, the controller may cause one or more paddles 500 to emit light in different manner from each other, as such flashing, changing brightness, and operating in a predetermined sequence, and the like.

Figure 7:
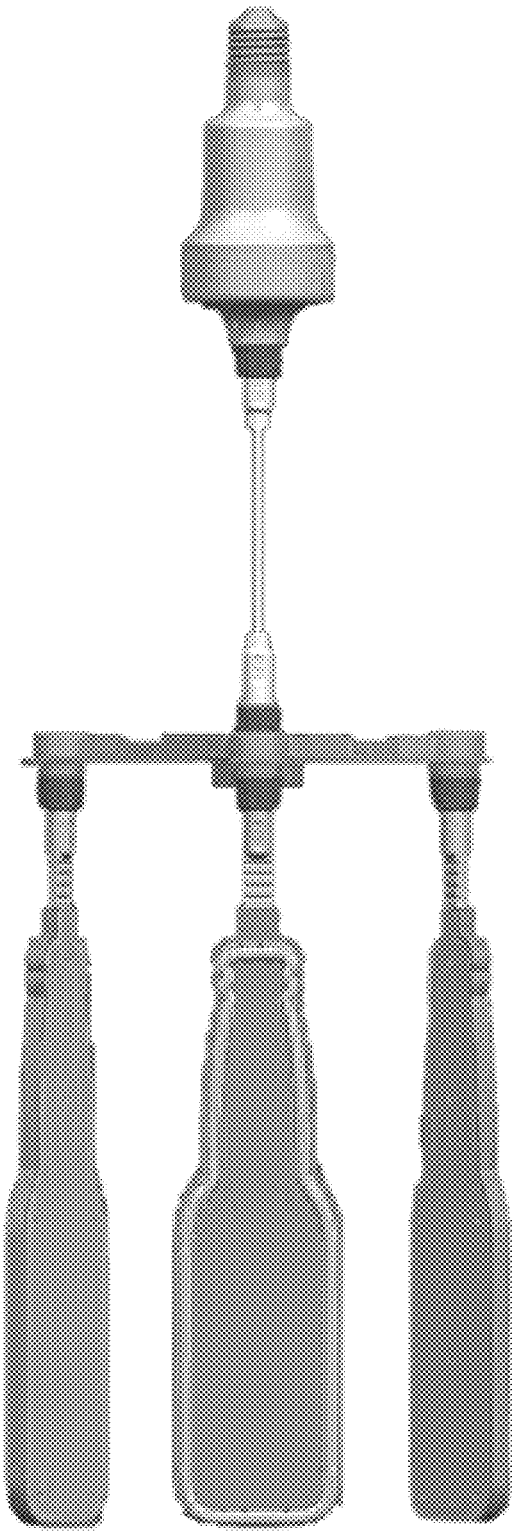
FIG. 7 is a schematic view of a candolier having an adaptor, multi-piece attachment member and three paddles in the form of lighted beer bottles according to an exemplary embodiment.

FIG. 7 is a schematic view of a candolier having a lighting power adaptor, multi-piece attachment member, and three paddles in the for of lighted beer bottles according to an exemplary embodiment.

Referring the FIG. 7, the candolier according to an exemplary embodiment includes a lighting power adaptor, a multi-piece attachment member having a cross shape, attachments, and paddles coupled to each other. As used herein, a "candolier" may refer to one particular implementation utilizing a lighting power adaptor constructed according to the principles of the invention, and may include at least one or more paddles coupled thereto. As shown in FIG. 7, the paddles according to an exemplary embodiment have substantially a bottle shape, and a light emitting device is formed around the substantially bottle shape to highlight ornamental aspects of a bottle. Such a candolier may be particularly advantageous for use as advertisements for beverages in retail or other locations.

Figure 8A:
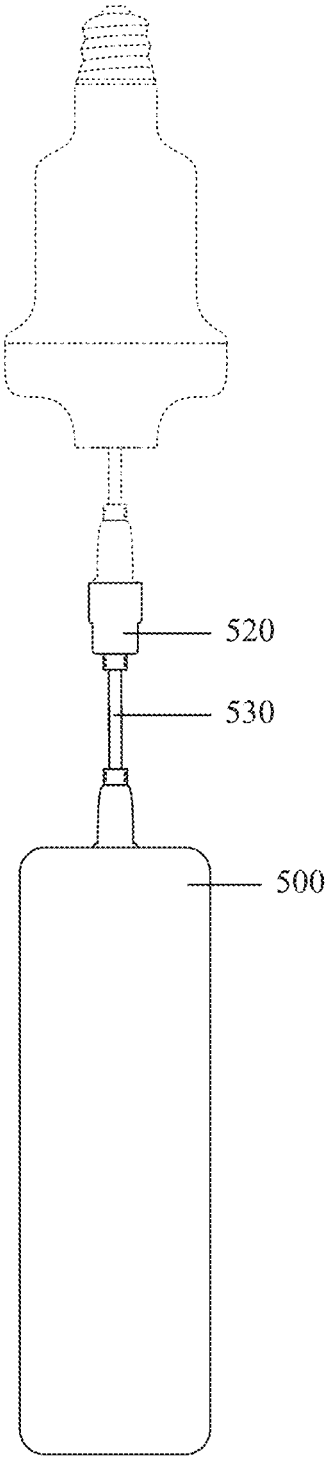
FIGS. 8A, 8B, and 8C are schematic front view and side view of a paddle according to exemplary embodiments.
Figure 8B:
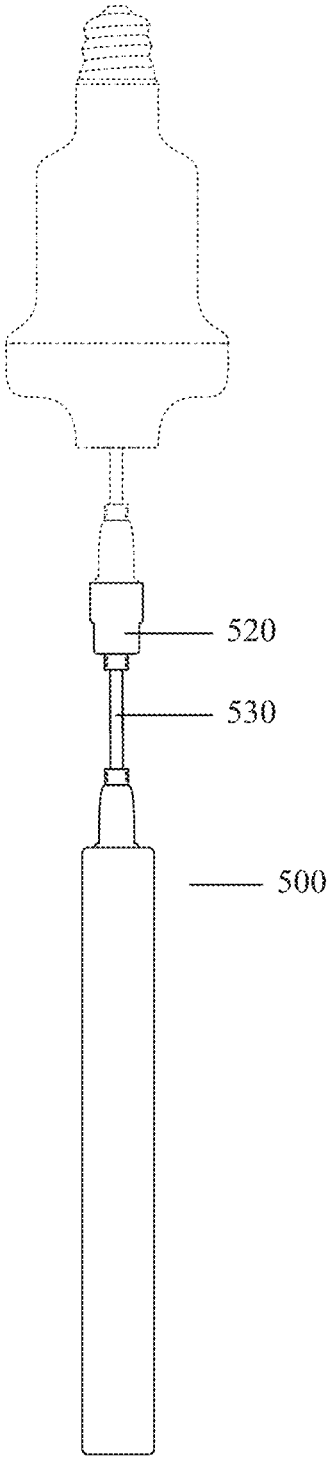
Figure 8C:
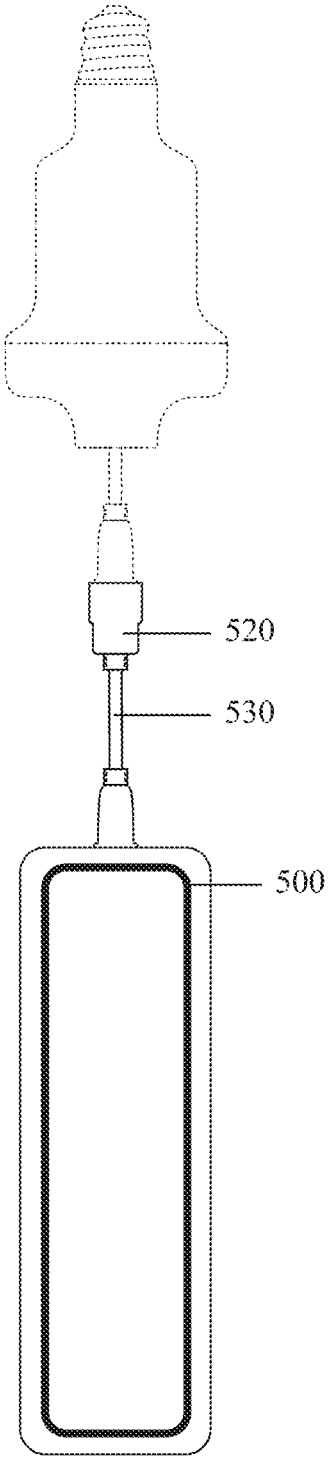

FIGS. 8A, 8B, and 8C are schematic front and side views of a paddle according to exemplary embodiments. More particularly, FIGS. 8A and 8B are a front view and a side view of a paddle according to an exemplary embodiment, respectively.

Referring to FIGS. 8A and 8B, the paddle 500 according to an exemplary embodiment may be coupled to a lighting power adaptor without a multi-piece attachment member of FIG. 2. The paddle 500 shown in FIG. 8A is substantially similar to the paddle described above, and thus, detailed descriptions thereof will be omitted to avoid redundancy. When the candolier does not include the multi-piece attachment member, the paddle 500 may be directly coupled to the lighting power adaptor without the attachment. In this case, the paddle 500 may further include a third cover 520 and a second shaft 530 on a top portion thereof.

The third cover 520 may be substantially similar to the second cover of the multi-piece attachment member 200, in that the third cover 520 includes a coupler, such as a thread, to be connected to the socket coupler 190 of the lighting power adaptor 100. In addition, the second shaft 530 of the paddle 500 may be substantially similar to the shaft of the shaft in the multi-piece attachment member 200, in that the second shaft 530 extends between the cover of the main housing and the paddle 500. In some implementations, the third cover 520 may include a motor or the like to cause the second shaft 530 and/or the paddle 500 to rotate around the lighting power adaptor. For example, one or more of the third cover 520, the second shaft 530, and the paddle 500 may include conductors electrically contacting each other at an interface therebetween to provide electrical path without employing a wiring, such that electrical connection between the members may not be adversely affected by the rotational movement of the paddle 500. A portion of third cover 520 may surround a portion of the cover of the main housing to prevent infiltration of impurities and prevent electrical shock to a user.

According to an exemplary embodiment, the paddle 500 may further include a shatterproof layer 550 on one surface thereof as shown in FIG. 8C, which may prevent damage to the paddle 500 from external impact.

FIGS. 9A, 9B, 9C, and 9D are schematic side views of a paddle according to exemplary embodiments.

Figure 9A:
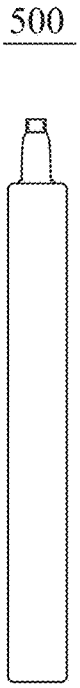
FIGS. 9A, 9B, 9C, and 9D are schematic side view of a paddle according to exemplary embodiments.
Figure 9B:
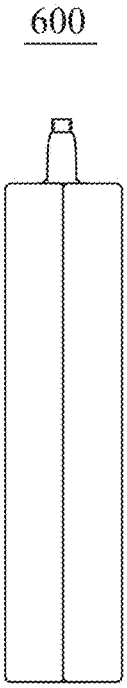

FIG. 9A shows a side view of a paddle 500 according to an exemplary embodiment. According to another exemplary embodiment, as shown in 9B, two paddles may adjoin each other to form one paddle 600, and each of the adjoined paddles may have the same or different ornamental features on a surface thereof. The paddle 600 may further include the third cover 520 and the second shaft 530 to be coupled to the lighting power adaptor of FIG. 1.

Figure 9C:
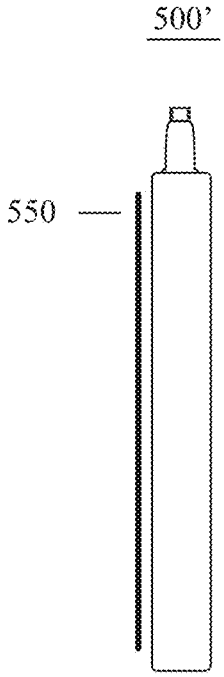
Figure 9D:
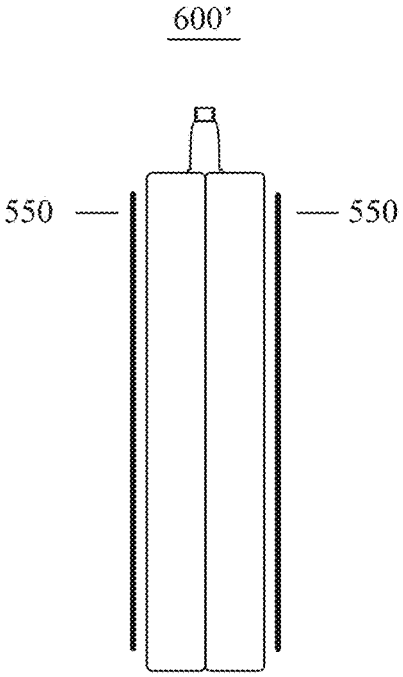

According to exemplary embodiments, the shatterproof layer 550 may be formed on a surface of the paddle 500', or on each surface of the paddle 600' as shown in FIGS. 9C and 9D. The paddles 500' and 600' are substantially the same as the paddle 500 and 600, respectively, other than the shatterproof layer 550 formed on a surface thereof, and thus, detailed descriptions thereof will be omitted to avoid redundancy.

Figure 10:
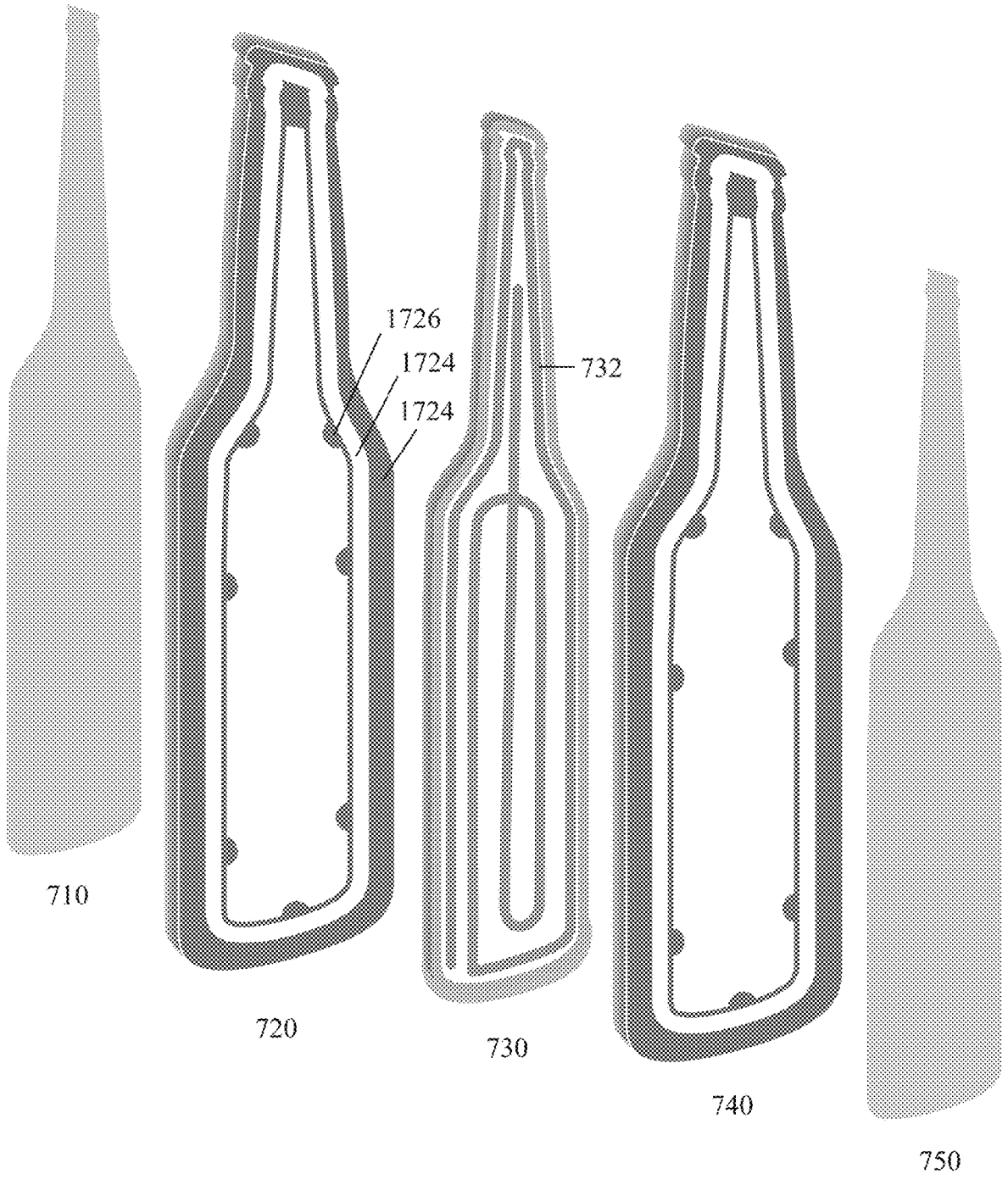
FIG. 10 is an exploded view of a paddle according to an exemplary embodiment.

FIG. 10 is an exploded view of a paddle according to an exemplary embodiment.

Referring to FIG. 10, a paddle 700 according to an exemplary embodiment may include a first ornamental cover 710, a second ornamental cover 720, a light source 730, a third ornamental cover 740, and a fourth ornamental cover 750. In some exemplary embodiments, the paddle 700 may be coupled to a lighting power adaptor without a multi-piece attachment member of FIG. 2. In this case, the paddle 700 may further include a third cover 520 and a second shaft 530 (see FIG. 8A) described above. The paddle 700 shown in FIG. 10 has a beer bottle shape, however, the inventive concepts are not limited thereto, and the paddle 700 may be formed to have any desired shape. For example, the paddle 700 may have any one shape of stars, circles, ovals, squares, rectangles, logos, shields, ribbons, pennant shapes, triangles, squares, and even all types of 3D shapes like ghosts, Christmas trees, spiders, fireworks, sports shapes, superheroes, cats, dogs, dinosaurs, unicorns, fairies and any part thereof, without being limited thereto. In addition, the paddle 700 may be formed to include multiple items, such as bottles or logos, The first ornamental cover 710 may be formed of a printed sheet, for example, and has a desired shape, such as a beer bottle. The first ornamental cover 710 may include a translucent material to partially transmit light emitted from the light source 730, without being limited thereto. The second ornamental cover 720 may have a shape substantially similar to that of the first ornamental cover 710. The second ornamental cover 720 according to an exemplary embodiment may include an outer frame 722, a shatterproof layer 724, and ornaments 726. The second ornamental cover 720 may include a rigid material, and may be formed of a polymer, such as acryl, or metal, without being limited thereto. The shatterproof layer 724 may be formed inside the outer frame 722, and may include a material that may protect the paddle 700, more particularly, the light source 730, from external impact. The ornaments 726 may be formed inside the center of the paddle 700 to enhance visual effect of the paddle 720. In some exemplary embodiments, the center region of the paddle 700 surrounded by the shatterproof layer 724 may be empty, or may include a light transmitting material.

The light source 730 according to an exemplary embodiment may emit light in response to receiving converted power from a lighting power adaptor through the second shaft (see FIG. 8A). The light source 730 may include an LED strip 732, for example, which may illuminate one or more ornamental covers disposed thereon. In particular, the LED strip 732 may backlight the first, second, third, and fourth ornamental covers 710, 720, 740, and 750, to shine the paddle 700.

The third ornamental cover 740 and the fourth ornamental cover 750 are substantially similar to the second ornamental cover 720 and the first ornamental cover 710, respectively, and thus, repeated descriptions thereof will be omitted to avoid redundancy. In some exemplary embodiments, however, the third and fourth ornamental covers 740 and 750 may have shape different from the second and first ornamental covers 720 and 710, respectively. In some exemplary embodiments, the thickness of each of the second ornamental cover 720, the light source 730, and the fourth ornamental cover 740 may be about 0.25 inch, however, inventive concepts are not limited to a particular size of the elements forming the paddle 700.

Figure 11A:
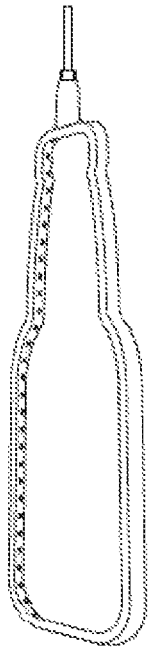
FIGS. 11A and 11B are views of a paddle according to another exemplary embodiment.
Figure 11B:
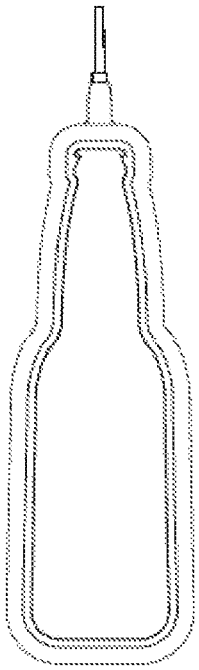

FIGS. 11A and 11B are views of a paddle according to another exemplary embodiment.

Referring to FIGS. 11A and 11B, the paddle 800 according to an exemplary embodiment is substantially the same the paddle 700 of FIG. 10, and thus, detailed descriptions of the substantially similar elements will hereinafter be omitted to avoid redundancy. In the paddle 800 according to the illustrated exemplary embodiment, the light source may include an LED strip disposed around the periphery of the light source to illuminate at least one or more covers disposed thereon. For example, at least one of the covers disposed on the light source may have an outer frame, which may a shape substantially corresponding to a shape of the periphery of the light source. In an exemplary embodiment, the outer frame of the cover may have a color and transmit light therethrough. In this manner, the paddle 800 may display a desired color along the periphery thereof. The outer frame of the cover may be replaced with the a different outer frame having another color, or the LED strip may be configured to emit a desired color to have substantially the same effect. In some exemplary embodiments, the LED strip may also be disposed in the interior of the light source.

Figure 12A:
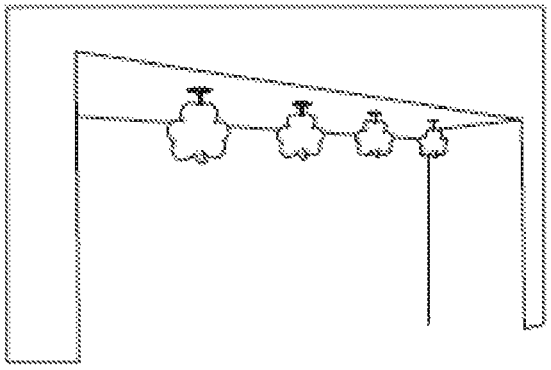
FIGS. 12A, 12B, and 12C are views of a various candoliers according to exemplary embodiments.
Figure 12B:
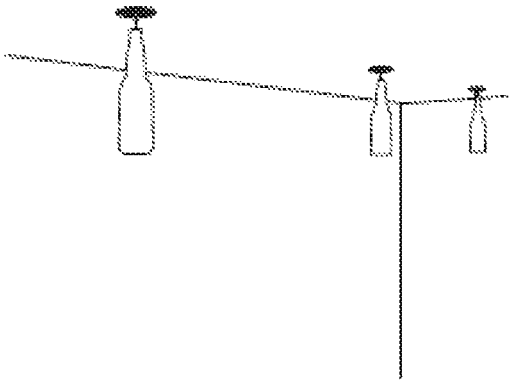
Figure 12C:
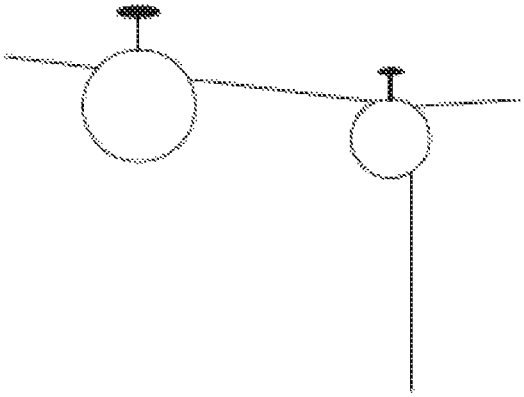

FIGS. 12A, 12B, and 12C are schematic views of various candoliers according to exemplary embodiments.

FIGS. 12A, 12B, and 12C show some implementations of the candolier according to exemplary embodiments. Referring to FIGS. 12A, 12B, and 12C, a candolier is coupled to a recessed light socket in a retail store, and a paddle coupled to a lighting power adaptor may include a light emitting device incorporated as an ornamental device. The ornamental device may be formed as any useful article, such as a clover leaf, a beer bottle, a sign, a symbol, a logo, and other objects, etc.

Some of the advantages that may be achieved by exemplary implementations of the invention include providing a paddle having a desired shape and incorporating DC powered light emitting device may be easily used in standard AC light sockets. In addition, a candolier according to exemplary embodiments may provide a platform for using multiple three dimensional DC powered light emitting paddles from a single existing AC power source that can be easily replaced with another paddle as desired.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A candolier comprising:

a main body having a first coupler configured to be connected to an external AC socket;

an auxiliary body having a second coupler;

a connector extending from the main body to the auxiliary body;

an extender comprising:

a third coupler connected to the second coupler; and a multi-port member having a plurality of receptacles configured to be coupled to DC powered light emitting devices.

2. The candolier of claim 1, wherein the third coupler is disposed at one end of the extender and the multi-port member is disposed at the other end thereof.

3. The candolier of claim 1, wherein the extender further comprises a shaft extending between the second coupler and the multi-port member, and the multi-port member is configured to rotate around the main body.

4. The candolier of claim 1, wherein the receptacles comprise adapter insertion ports disposed around the periphery of the multi-port member.

5. The candolier of claim 1, further comprising an attachment disposed between the multi-port member and the DC powered light emitting device, the attachment having a first end coupled to one of the receptacles and a second, opposing end configured to be coupled to the DC powered light emitting device.

6. The candolier of claim 1, wherein the DC powered light emitting device comprises a light emitting diode incorporated into an ornamental device selected from at least one of a useful article, sign decoration, logo, paddle, bottle, clover, and sign.

7. The candolier of claim 1, wherein the first, second, and third couplers comprise threads.

8. The candolier of claim 1, wherein the connector comprises at least one flexible member.

* * * * *